US008711191B2

(12) United States Patent
Kawaguchi et al.

(10) Patent No.: US 8,711,191 B2
(45) **Date of Patent: *Apr. 29, 2014**

(54) IMAGE ERASING APPARATUS AND RECORDING MEDIUM CONVEYING METHOD FOR IMAGE ERASING APPARATUS

(71) Applicants: Toshiba Tec Kabushiki Kaisha, Tokyo (JP); Kabushiki Kaisha Toshiba, Tokyo (JP)

(72) Inventors: Takahiro Kawaguchi, Shizuoka (JP); Isao Yahata, Shizuoka (JP); Hiroyuki Taguchi, Shizuoka (JP); Ken Iguchi, Shizuoka (JP); Hiroyuki Tsuchihashi, Shizuoka (JP); Hiroyuki Taki, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/846,274

(22) Filed: Mar. 18, 2013

(65) Prior Publication Data

US 2013/0229476 A1 Sep. 5, 2013

Related U.S. Application Data

(62) Division of application No. 12/817,732, filed on Jun. 17, 2010, now Pat. No. 8,427,516.

(60) Provisional application No. 61/218,831, filed on Jun. 19, 2009, provisional application No. 61/242,719, filed on Sep. 15, 2009.

(51) Int. Cl.
*B41J 2/32* (2006.01)

(52) U.S. Cl.
USPC ..... 347/171; 347/179; 347/218

(58) Field of Classification Search
USPC ..... 347/171, 179, 218; 400/120.01, 695, 400/699
See application file for complete search history.

(56) References Cited

U.S. PATENT DOCUMENTS

| | | | | |
|---|---|---|---|---|
| 8,427,516 | B2 * | 4/2013 | Kawaguchi et al. | 347/171 |
| 2011/0074901 | A1 | 3/2011 | Tsuchihashi et al. | |

FOREIGN PATENT DOCUMENTS

| | | |
|---|---|---|
| JP | 08-076534 | 3/1996 |
| JP | 08-091602 | 4/1996 |
| JP | 2009-137716 | 6/2009 |

* cited by examiner

*Primary Examiner* — Huan Tran
(74) *Attorney, Agent, or Firm* — Patterson & Sheridan, L.L.P.

(57) ABSTRACT

An image erasing apparatus includes: a paper feeding tray configured to feed a recording medium; a sensor group including a double-feed detection sensor configured to detect double feed of the recording medium and a media sensor configured to detect the thickness of the recording medium; a recording-medium collecting device, a collection box, or a discharge box configured to collect the recording medium; and a recording-medium conveying device connecting the paper feeding tray, the sensor group, and the recording-medium collecting device, the collection box, or the discharge box on a straight line.

20 Claims, 7 Drawing Sheets

IMAGE ERASING APPARATUS AND RECORDING MEDIUM CONVEYING METHOD FOR IMAGE ERASING APPARATUS

CROSS-REFERENCE TO RELATED APPLICATIONS

This application is a divisional of U.S. patent application Ser. No. 12/817,732, filed on Jun. 17, 2010, which is based upon and claims the benefit of priority from the prior the U.S. Patent Application No. 61/218,831, filed on Jun. 19, 2009, and the prior the U.S. Patent Application No. 61/242,719, filed on Sep. 15, 2009 and the entire contents of which are incorporated herein by reference.

FIELD

An embodiment of the present invention relates to an image erasing apparatus configured to erase an image on a recording medium formed with an erasable developer and a recording medium conveying method for the image erasing apparatus.

BACKGROUND

In recent years, an image forming apparatus configured to form an image with an erasable developer and an erasing apparatus were introduced according to the demand for resource saving. The erasing apparatus erases an image by applying heat and light to a recording medium on which the image is formed with the erasable developer and erasing the developer. Therefore, the recording medium after the image is erased can be reused.

In some case, a recording medium an which an image is once formed is stapled or affixed with a tag or the like. Such a recording medium clogs a recording medium conveying path and causes a jam or damages the apparatus.

As measures against such a problem, there is proposed a technique for providing a detecting device configured to detect double feed and stopping conveyance of a recording medium when the double feed is detected.

There is also proposed a technique for providing, halfway in the recording medium conveying path, a sensor configured to detect the thickness of a recording medium and discharging the recording medium to the outside of the apparatus via the normal recording medium conveying path when the recording medium has unexpected thickness.

DETAILED DESCRIPTION

Figure 1:
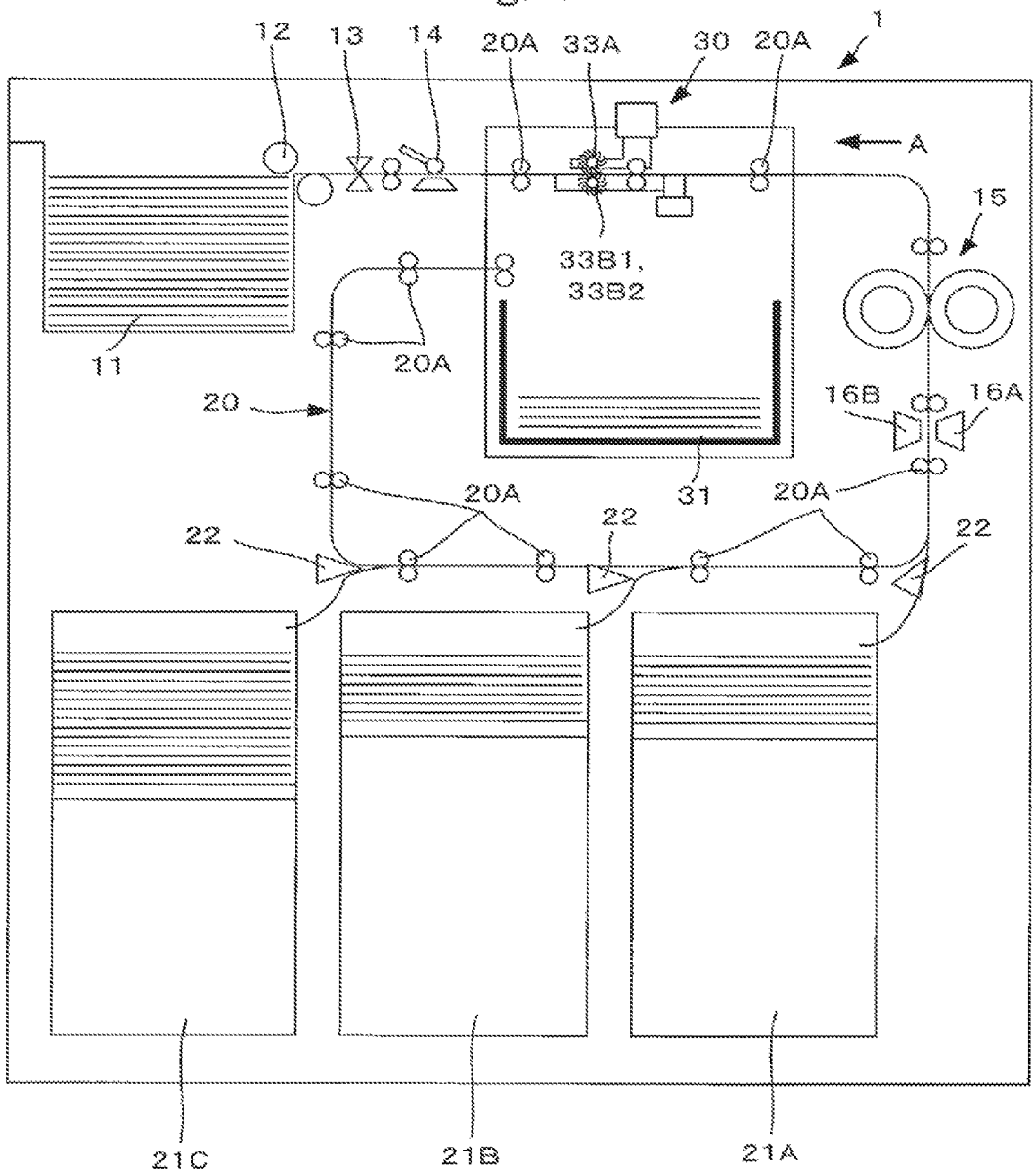
FIG. 1 is a side view of the configuration of art image erasing apparatus.

Throughout this description, the embodiments and examples shown should be considered as exemplars, rather than limitations on the apparatus and methods of the present invention.

An image erasing apparatus and a recording medium conveying method for the image erasing apparatus according to an embodiment of the present invention are explained in detail below with reference to the accompanying drawings.

The image erasing apparatus includes: a paper feeding tray configured to teed the recording medium; a sensor group including a double-feed detection sensor configured to detect double feed of the recording medium and a media sensor configured to detect thickness of the recording medium; a collecting device configured to collect the recording medium; a recording-medium conveying device configured to convey the recording medium, the recording-medium conveying device linearly connecting the paper feeding tray, the sensor group, and the collecting device; a switching device configured to switch a conveying direction of the recording medium; a heating device configured to heat the recording medium to temperature equal to or higher than erasing temperature of a developer; and a control unit configured to operate the switching device in the direction to collect the recording medium in the collecting device if the recording medium is judged non-conveyable on the basis of an output of the sensor group and operate the switching device in the direction to convey the recording medium to the heating device if the recording medium is judged conveyable on the basis of an output of the sensor group.

An image erasing apparatus 1 includes: a paper feeding tray configured to feed a recording medium; a sensor group including a double-feed detection sensor configured to detect double feed of the recording medium and a media sensor configured to detect the thickness of the recording medium; a recording-medium conveying device configured to convey the recording medium; a collecting device provided in the recording-medium conveying device and configured to drop and collect the recording medium; a switching device configured to switch a conveying direction of the recording medium; a heating device configured to heat the recording medium to temperature equal to or higher than erasing temperature of a developer; a stacking device configured to stack the recording medium; and a control unit configured to cause, when determining on the basis of an output of the double-feed detection sensor or the media sensor that the recording medium is non-conveyable, the recording-medium conveying device to collect the recording medium in the collecting device and cause, when determining that the recording medium is conveyable, the recording-medium conveying device to convey the recording medium in the direction of the heating device and cause the heating device to erase an image.

Each of image erasing apparatuses 1, 2, and 3 according to this embodiment include a paper feeding tray 11 configured to feed a recording medium, a sensor group including a double-feed detection sensor 13 configured to detect double feed of the recording medium and a media sensor 14 configured to detect the thickness of the recording medium, a collecting device configured to drop the recording medium in the vertical direction and collect the recording medium, and a recording-medium conveying device 20 configured to convey the recording medium.

FIG. 1 is a side view of the configuration of the image erasing apparatus 1 according to this embodiment. As shown in FIG. 1, the image erasing apparatus 1 includes the paper feeding tray 11 on which recording media to be subjected to image erasing are stacked, a paper feeding device 12 configured to extract a recording medium from the paper feeding tray 11, the recording-medium conveying device 20 configured to convey the recording medium, and a sensor group including the double-feed detection sensor 13 configured to detect double feed of the recording medium and the media sensor 14 configured to detect the thickness of the recording medium.

The recording-medium conveying device 20 includes plural conveying rollers 20A and a switching device 22 configured to switch a conveying path.

The double-feed detection sensor 13 includes an ultrasound generating device configured to emit ultrasound from one side of the recording medium to the recording medium and an ultrasound detecting device set en the other side of the recording medium and configured to detect the ultrasound. The double-feed detection sensor 13 outputs an electric signal on the basis of the detected ultrasound. The image erasing apparatus 1 determines presence or absence of double feed on the basis of the electric signal.

The media sensor 14 includes an arm displaced by the passage of the recording medium, a permanent magnet set in the arm, and a magnetic sensor configured to detect magnetism of the permanent magnet. The media sensor 14 outputs an electric signal corresponding to the thickness of the recording medium. The image erasing apparatus 1 determines the thickness of the recording medium on the basis of the electric signal.

The image erasing apparatus 1 includes, downstream in a recording medium conveyance direction of the sensor group, a recording-medium collecting device 30 and a collection box 31 configured to store a collected recording medium.

The recording-medium conveying device 20 is formed on a straight line from the paper feeding device 12 to the recording-medium collecting device 30. The recording-medium conveying device 20 connecting the paper feeding device 12, the sensor group, and the recording-medium collecting device 30 is formed on the straight line. The paper feeding device 12, the sensor group, and the recording-medium collecting device 30 are arranged on the straight line. The image erasing apparatus 1 conveys the recording medium from the paper feeding device 12 to the recording-medium collecting device 30 without bending the recording medium.

The image erasing apparatus 1 includes a heating device 15 downstream in the recording medium conveyance direction of the recording-medium collecting device 30. In the heating device 15, a pair of rollers are provided on both sides of the recording-medium conveying device 20. The heating device 15 heats the recording medium to erasing temperature that is temperature at which a color of a developer on the recording medium is erased. Therefore, the image erasing apparatus 1 subjects the recording medium to image erasing with the heating device 15.

The image erasing apparatus 1 includes a pair of scanners 16A and 16B as image reading devices downstream in the recording medium conveyance direction of the heating device 15. The scanners 16A and 16B are provided on both sides of the recording-medium conveying device 20. The image erasing apparatus 1 determines on the basis of outputs of the scanners 16A and 16B whether image erasing for the recording medium is successful.

The image erasing apparatus 1 includes, downstream in the recording medium conveyance direction of the scanners 16A and 16B, stacking devices 21A, 21B, and 21C configured to store recording media. The image erasing apparatus 1 operates the switching device 22 to thereby stack recording media for which image erasing is unsuccessful in the collection box 31 and stack recording media for which image erasing is successful in the stacking devices 21A to 21C while sorting the recording media according to sizes.

Figure 2:
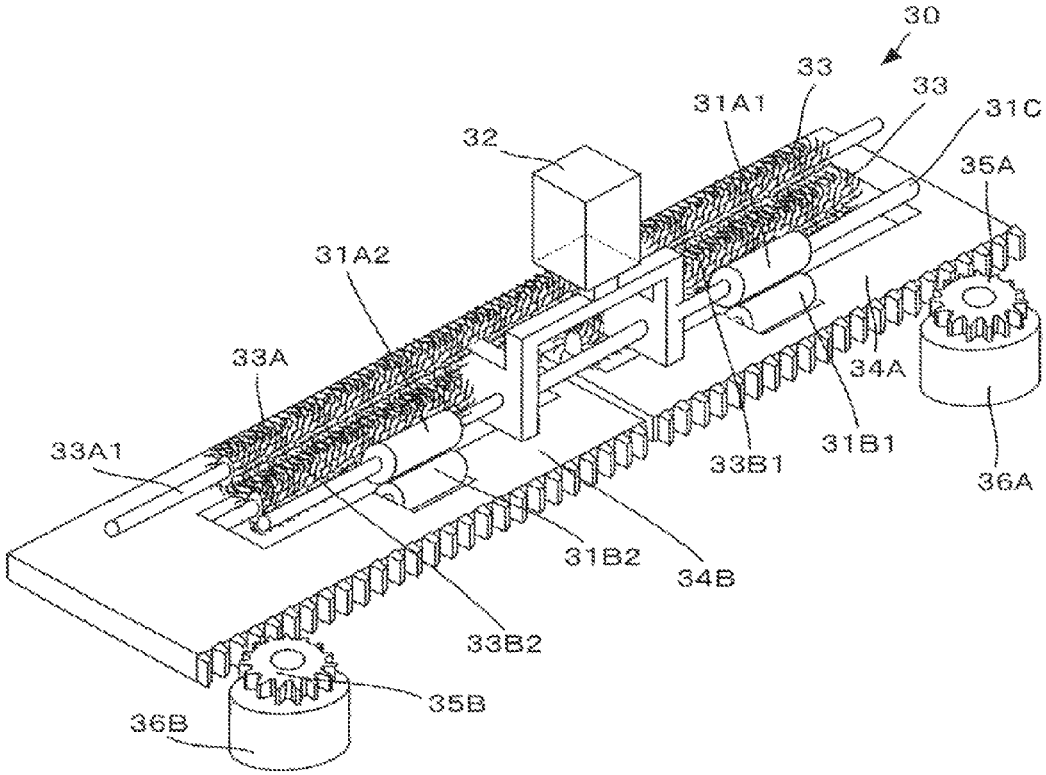
FIG. 2 is a perspective view of a recording-medium collecting device.
Figure 3:
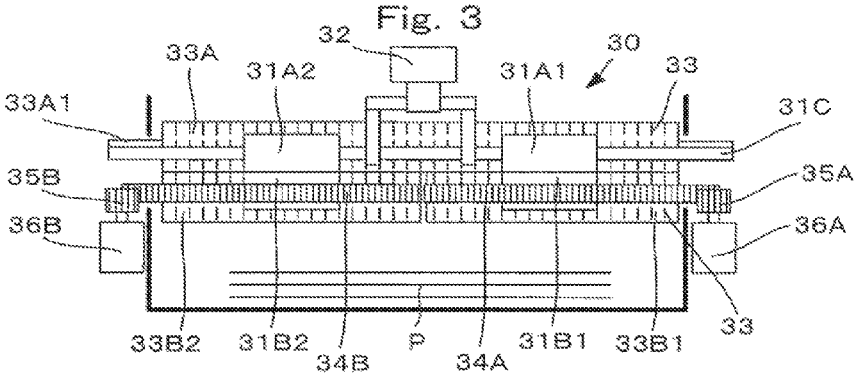
FIG. 3 is a front view of the recording-medium collecting device viewed from a direction of an arrow A in FIG. 1.

FIG. 2 is a perspective view of the recording-medium collecting device 30. FIG. 3 is a front view of the recording-medium collecting device 30 viewed from a direction of an arrow A in FIG. 1.

As shown in FIGS. 2 and 3, the recording medium collecting device 30 includes a roller lifting and lowering device 32, driving rollers 31A1 and 31A2 driven by a driving motor, driven rollers 31B1 and 31B2 configured to rotate following the driving rollers 31A1 and 31A2, and a first brush roller 33A including a brush 33.

A rotating shaft 33A1 of the first brush roller 33A and a rotating shaft 31C of the driving rollers 31A1 and 31A2 are supported by the roller lifting and lowering device 32. The roller lifting and lowering device 32 is lifted and lowered by a solenoid or the like.

The recording-medium collecting device 30 includes a pair of movable plates 34A and 34B. The movable plates 34A and 34B have plural teeth on sides thereof. The recording-medium collecting device 30 includes motors 36A and 36B including gears 35A and 35B. The teeth on the sides of the movable plates 34A and 34B mesh with the gears 35A and 35B.

The movable plates 34A and 34B rotatably support second brush rollers 33B1 and 33B2 having the brush 33 and the driven rollers 31B and 31B2, respectively.

The length of the first brush roller 33A is equal to total length of the second brush rollers 33B1 and 33B2 and larger than maximum width of a conveyable recording medium.

As a material of the brush 33, plastic such as nylon or animal hair such as pig hair can be used.

The first brush roller 33A and the second brush rollers 33B1 and 33B2 rotate in a direction opposite to a direction of conveyance of a recording medium and remove tag paper and foreign matters such as bits of eraser grit adhering to the conveyed recording medium from the recording medium.

Figure 4:
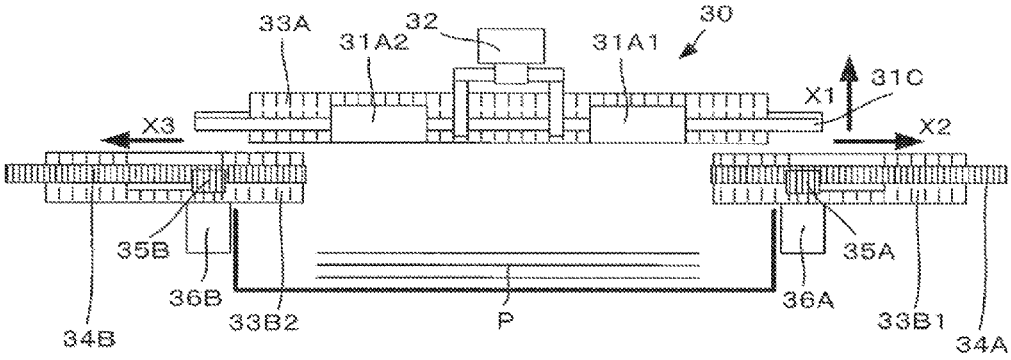
FIG. 4 is a diagram of a state of recording medium collecting operation by the recording-medium collecting device.

FIG. 4 is a diagram of a state of recording medium collecting operation by the recording-medium collecting device 30. As shown in FIG. 4, when detecting from an output of the double-feed detection sensor 13 or the media sensor 14 that double feed occurs, a recording medium has thickness larger than a first threshold set in advance, or a recording medium has thickness smaller than a second threshold set in advance, the image erasing apparatus 1 causes the recording-medium collecting device 30 to perform the recording medium collecting operation.

Specifically, when determining that a recording medium is non-conveyable, the image erasing apparatus 1 lifts the roller lifting and lowering device 32 to pull the brush roller 33A and the driving rollers 31A1 and 31A2 upward, i.e., in an arrow X1 direction and release nip of the recording medium.

Subsequently, the image erasing apparatus 1 rotates the motor 36A to displace the movable plate 34A in an arrow X2 direction and rotates the motor 36B to displace the movable plate 34B in an arrow X3 direction. Specifically, the image erasing apparatus 1 opens the movable plates 34A and 34B in a vertical direction with respect to the recording medium conveyance direction.

According to this recording medium collecting operation, the recording-medium collecting device 30 drops a non-conveyable recording medium in the vertical direction to the collecting box 31 and collects the recording medium.

Usually, a jam tends to be caused when a stapled sheet bundle or a sheet is double-fed or a sheet having thickness other than specified thickness is conveyed. In particular, when a conveying path is bent, it is highly likely that a sheet is non-conveyable and jams. However, since the image erasing apparatus 1 conveys a recording medium from the paper feeding device 12 to the recording-medium collecting device 30 without bending the recording medium, it is possible to prevent an unnecessary jam.

Figure 5:
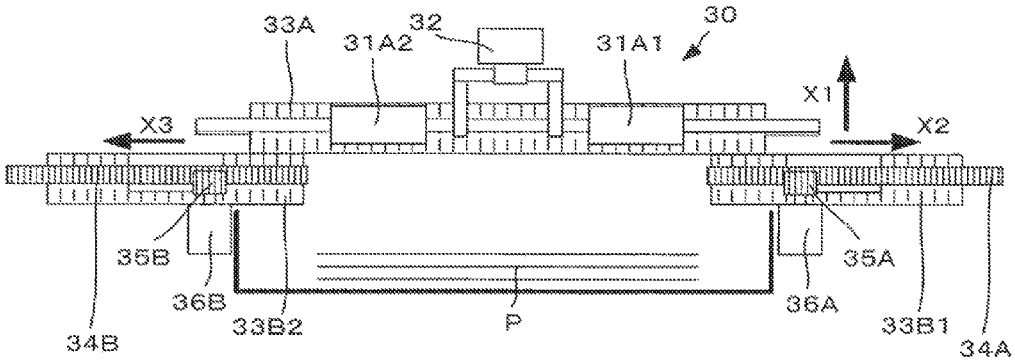
FIG. 5 is a diagram of recording medium collecting operation of a recording-medium collecting device according to a first application example.

FIG. 5 is a diagram of recording medium collecting operation by the recording-medium collecting device 30 according to a first application example. As shown in FIG. 5, in the recording medium collecting device 30 according to the first application example, the rotating shaft 31C of the driving rollers 31A1 and 31A2 is supported by the roller lifting and lowering device 32. The rotating shaft 33A1 of the brush roller 33A is not supported by the roller lifting and lowering device 32.

Therefore, the driving rollers 31A1 and 31A2 rise according to the recording medium collecting operation. The brush roller 33A does not rise according to the recording medium collecting operation.

Figure 6:
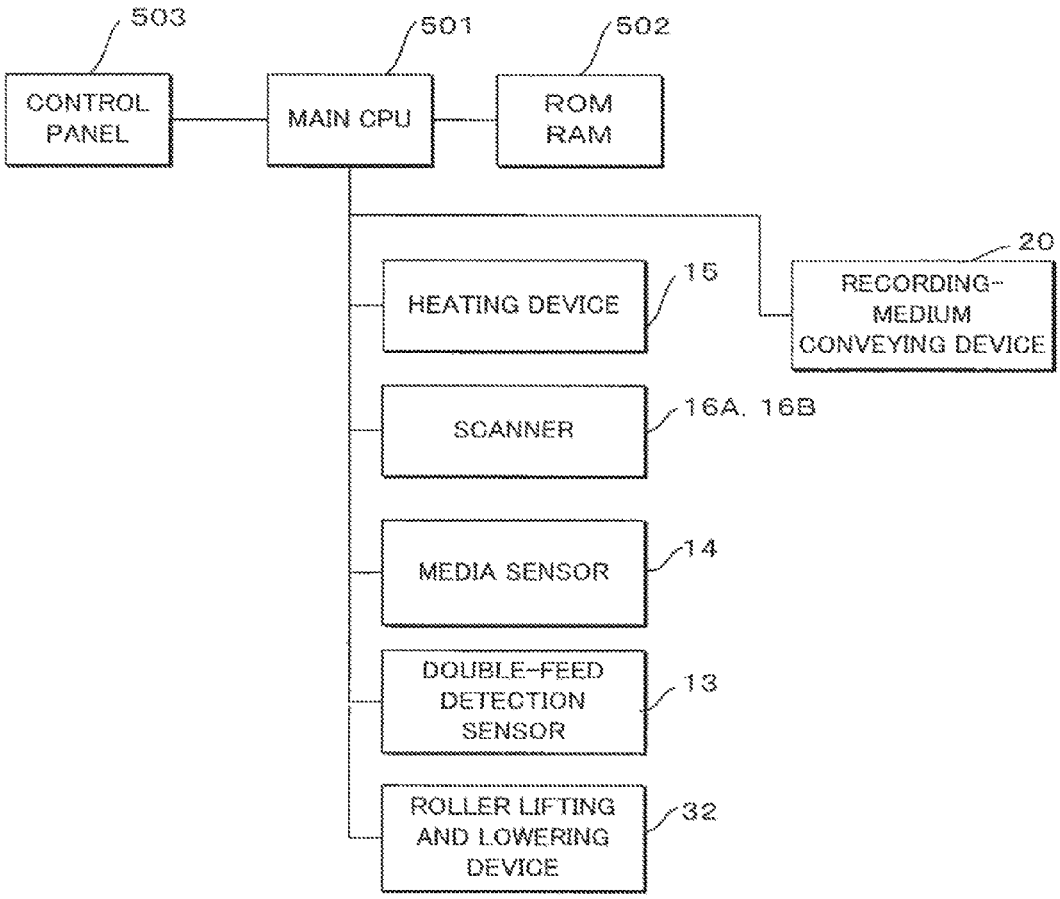
FIG. 6 is a block diagram of the configuration of the image erasing apparatus.

FIG. 6 is a block diagram of the configuration of the image erasing apparatus 1. As shown in FIG. 6, the image erasing apparatus 1 includes a main CPU 501 as a control unit (a controller). The main CPU 501 is connected to a control panel 503 and a ROM and RAM 502 as a storage device.

The main CPU 501 is connected to the heating device 15, the scanners 16A and 16B, the media sensor 14, the double-feed detection sensor 13, and the roller lifting and lowering device 32. The main CPU 501 controls the recording-medium conveying device 20. The main CPU 501 controls ON and OFF and the temperature of the heating device 15.

Figure 7:
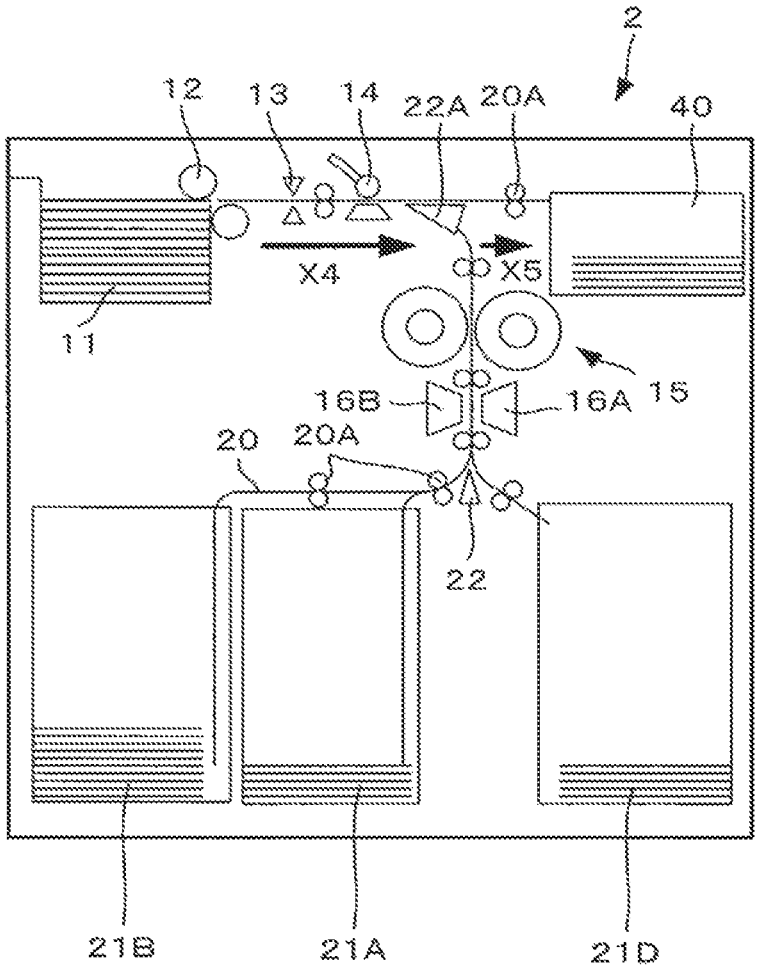
FIG. 7 is a side view of the configuration of an image erasing apparatus according to a second application example.

FIG. 7 is a side view of the configuration of an image erasing apparatus 2 according to a second application example. As shown in FIG. 7, the image erasing apparatus 2 includes the paper feeding tray 11 on which recording media to be subjected to image erasing are stacked, the paper feeding device 12 configured to extract a recording medium from the paper feeding tray 11, the recording-medium conveying device 20 configured to convey the recording medium, and the sensor group including the double-feed detection sensor 13 configured to detect double feed of the recording medium and the media sensor 14 configured to detect the thickness of the recording medium.

The recording-medium conveying device 20 includes the plural conveying rollers 20A and switching devices 22 and 22A configured to switch a conveying path.

The image erasing apparatus 2 includes a collection box 40 downstream in a recording medium conveyance direction of the sensor group. The switching device 22A is set between the sensor group and the collection box 40.

The recording-medium conveying device 20 is formed on a straight line from the paper feeding device 12 to the collection box 40. The recording-medium conveying device 20 connecting the paper feeding device 12, the sensor group, and the collection box 40 is formed on the straight line. The paper feeding device 12, the sensor group, and the collection box 40 are arranged on the straight line. The image erasing apparatus 2 conveys a recording medium from the paper feeding device 12 to the collection box 40 without bending the recording medium.

The image erasing apparatus 2 includes the heating device 15 downstream in the recording medium conveyance direction of the switching device 22A. In the heating device 15, a pair of rollers are provided on both sides of the recording-medium conveying device 20. The heating device 15 heats the recording medium to erasing temperature that is temperature at which a color of a developer on the recording medium is erased. Therefore, the image erasing apparatus 2 subjects the recording medium to image erasing with the heating device 15.

The image erasing apparatus 2 performs the recording medium collecting operation when detecting from an output of the double-feed detection sensor 13 or the media sensor 14 that double feed occurs, a recording medium has thickness larger than a first threshold set in advance, or a recording medium has thickness smaller than a second threshold set in advance.

Specifically, when determining that a recording medium is non-conveyable, the image erasing apparatus 2 operates the switching device 22A and conveys the recording medium in a direction of arrows X4 and X5. The recording medium is collected in the collection box 40.

Usually, a jam tends to be caused when a stapled sheet bundle or a sheet is double-fed or a sheet having thickness other than specified thickness is conveyed. In particular, when a conveying path is bent, it is highly likely that a sheet is non-conveyable and jams. However, since the paper feeding device 12, the sensor group, and the collection box 40 are arranged on the straight line, it is possible to prevent an unnecessary jam caused when a sheet bundle is caught.

When determining that a recording medium is conveyable, the image erasing apparatus 2 operates the switching device 22A and conveys the recording medium in the direction of the heating device 15.

The image erasing apparatus 2 includes the pair of scanners 16A and 16B as image reading devices downstream in the recording medium conveyance direction of the heating device 15. The scanners 16A and 168 are provided on both sides of the recording-medium conveying device 20. The image erasing apparatus 2 determines on the basis of outputs of the scanners 16A and 16B whether image erasing for the recording medium is successful.

The image erasing apparatus 2 includes, downstream in the recording medium conveyance direction of the scanners 16A and 16B, stacking devices 21A, 21B, and 21D configured to store recording media. The image erasing apparatus 2 operates the switching device 22 to thereby stack recording media for which image erasing is unsuccessful in the stacking device 21D and stack recording media for which image erasing is successful in the stacking devices 21A and 21B while sorting the recording media according to sizes.

Figure 8:
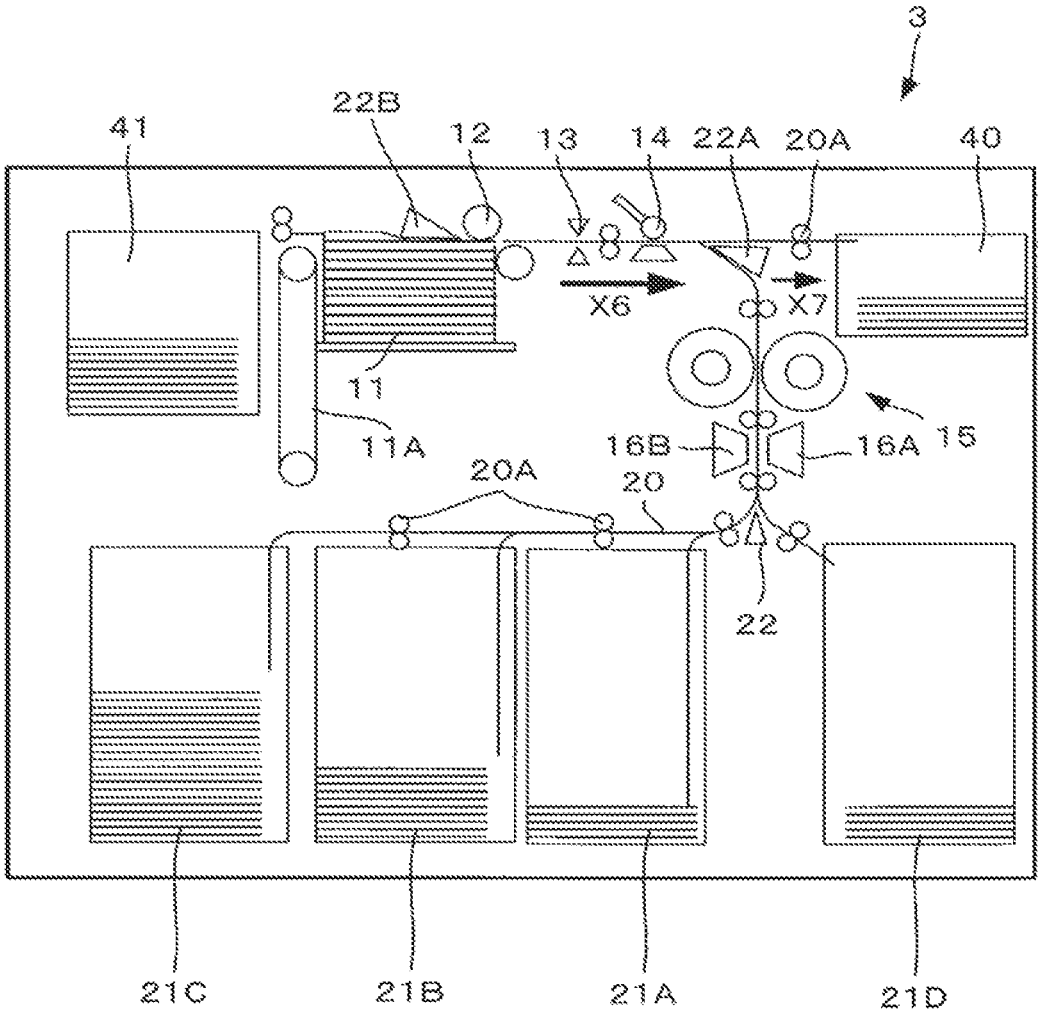
FIG. 8 is a side view of the configuration of an image erasing apparatus according to a third application example.

FIG. 8 is a side view of the configuration of an image erasing apparatus 3 according to a third application example. As shown in FIG. 8, the image erasing apparatus 3 includes the paper feeding tray 11 on which recording media to be subjected to image erasing are stacked, a paper-feeding-fray lifting and lowering device 11A configured to lift and lower the paper feeding tray 11, the paper feeding device 12 configured to extract a recording medium from the paper feeding tray 11, the recording-medium conveying device 20 configured to convey the recording medium, and the sensor group including the doable-feed detection sensor 13 configured to detect double feed of the recording medium and the media sensor 14 configured to detect the thickness of the recording medium.

The recording-medium conveying device 20 includes the plural conveying rollers 20A and switching devices 22, 22A, and 22B configured to switch a conveying path.

The image erasing apparatus 3 includes the collection box 40 downstream in a recording medium conveyance direction of the sensor group. The switching device 22A is set between the sensor group and the collection box 40.

The image erasing apparatus 3 includes a discharge box 41 further upstream than the paper feeding tray 11 in the recording medium conveyance direction.

The recording-medium conveying device 20 is formed on a straight line from the paper-feeding device 12 to the collection box 40 and from the paper feeding device 12 to the discharge box 41. The recording-medium conveying device 20 connecting the paper feeding device 12, the sensor group, and the collection box 40 is formed on the straight line. The recording-medium conveying device 20 connecting the paper feeding device 12 and the discharge box 41 is formed on the straight line.

The paper feeding device 12, the sensor group, and the collection box 40 are arranged on the straight line. The paper feeding device 12 and the discharge box 41 are arranged on the straight line. The image erasing apparatus 3 conveys a recording medium from the paper feeding device 12 to the collection box 40 and from the paper feeding device 12 to the discharge box 41 without bending the recording medium.

The image erasing apparatus 3 includes the heating device 15 downstream in the recording medium conveyance direction of the switching device 22A. In the heating device 15, a pair of rollers are provided on both sides of the recording-medium conveying device 20. The heating device 15 heats the recording medium to erasing temperature that is temperature at which a color of a developer on the recording medium is erased. Therefore, the image erasing apparatus 3 subjects the recording medium to image erasing with the heating device 15.

The image erasing apparatus 3 performs the recording medium collecting operation when detecting from an output of the double-feed detection sensor 13 or the media sensor 14 that double feed occurs, a recording medium has thickness larger than a first threshold set in advance, or a recording medium has thickness smaller than a second threshold set in advance.

Figure 9:
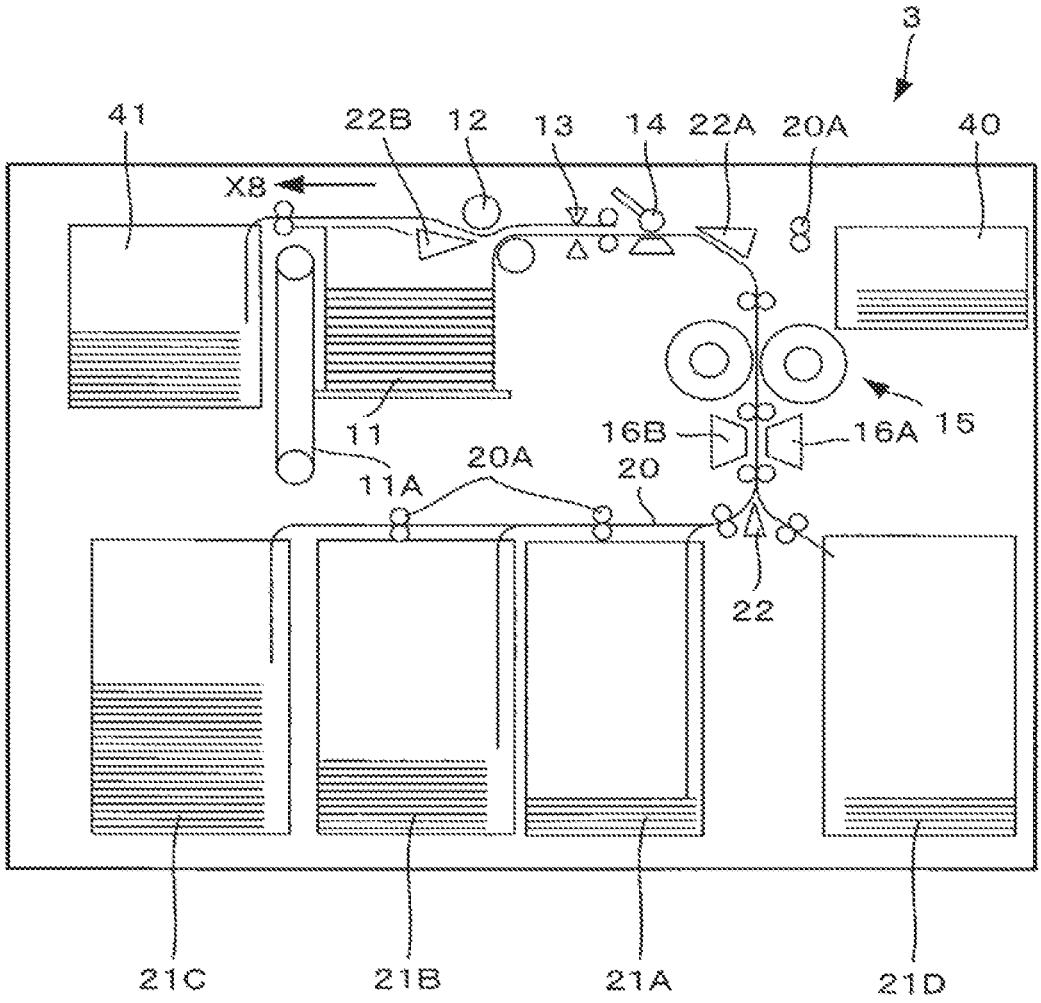
FIG. 9 is a side view of recording medium collecting operation of the Image erasing apparatus according to the second application example.

FIG. 9 is a side view of recording medium collecting operation by the image erasing apparatus 3 according to the third application example. As shown in FIG. 9, when the determining that a recording medium is non-conveyable, first, image erasing apparatus 3 stops conveyance of the recording medium. Subsequently, the image erasing apparatus 3 operates the paper-feeding-tray lifting and lowering device 11A to lower the paper feeding tray 11. The image erasing apparatus 3 operates the switching device 22B to form a recording medium conveying path reaching from the sensor group to the discharge box 41. The image erasing apparatus 3 reversely rotates the conveying roller 20A, conveys the recording medium in a direction of an arrow X8, and discharges the recording medium to the discharge box 41.

When determining that a recording medium is conveyable but is folded, the image erasing apparatus 3 operates the switching device 22A to convey the recording medium to the collection box 40 and collect the recording medium. The image erasing apparatus 3 determines, according to whether sheet thickness detected by the media sensor changes, whether the recording medium is folded.

When determining that the recording medium is conveyable and is not folded, the image erasing apparatus 3 operates the switching device 22A to convey the recording medium in a direction of the heating device 15.

The image erasing apparatus 3 includes the pair of scanners 16A and 16B as image reading devices downstream in the recording medium conveyance direction of the heating device 15. The scanners 16A and 16B are provided on both sides of the recording-medium conveying device 20. The image erasing apparatus 3 determines on the basis of outputs of the scanners 16A and 16B whether image erasing for the recording medium is successful.

The image erasing apparatus 3 includes, downstream in the recording medium conveyance direction of the scanners 16A and 16B, the stacking devices 21A, 21B, 21C, and 21D configured to store recording media. The image erasing apparatus 3 operates the switching device 22 to thereby stack recording media for which image erasing is unsuccessful in the stacking device 21D and stack recording media for which image erasing is successful in the stacking devices 21A to 21C while sorting the recording media according to sizes.

As explained above, each of the image erasing apparatuses 1, 2, and 3 according to this embodiment includes the paper feeding tray 11 configured to feed a recording medium, the sensor group including the double-feed detection sensor 13 configured to detect double feed of the recording medium and the media sensor 14 configured to detect the thickness of the recording medium, the recording-medium collecting device 30, the collection box 40, or the discharge box 41 configured to collect the recording medium, and the recording-medium conveying device 20 connecting the paper feeding tray 11, the sensor group, and the recording-medium collecting device 30, the collection box 40, or the discharge box 41 on a straight line.

Therefore, since it is possible to collect a non-conveyable recording medium without bending the recording medium, there is an effect that it is possible to efficiently prevent clogging or a jam of the recording medium.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. An image erasing apparatus which erases an image on a sheet on which the image is formed with a color material which is decolorized at a temperature equal to or higher than an erasing temperature, the apparatus comprising:

a paper feeding unit which feeds a sheet;

a conveying mechanism which conveys the sheet;

a detection unit which detects a state of the sheet that is fed;

a collecting device which is provided downstream in a sheet conveyance direction from the detection unit in a sheet conveying path and collects the sheet;

a heating device which heats the sheet to a temperature equal to or higher than the erasing temperature and thus decolorizes the image formed on the sheet with the color material; and a control unit which controls the sheet conveyance direction of the conveying mechanism and causes the collecting device to collect the sheet if it is determined that the sheet cannot be fed to the heating device based on an output from the detection unit, and which controls the sheet conveyance direction of the conveying mechanism and causes the heating device to erase the image on the sheet if it is determined that the sheet can be fed and conveyed to the heating device.

2. The apparatus according to claim 1, wherein the collecting device is installed downstream in the sheet conveyance direction from the detection unit and upstream in the sheet conveyance direction from the heating device.

3. The apparatus according to claim 2, wherein the collecting device comprises:

a drive roller and a driven roller which nip the sheet between the rollers and thus convey the sheet;

a roller lifting device which lifts and lowers the drive roller; and a movable plate which rotatably supports the driven roller and opens in a perpendicular direction to the sheet conveyance direction.

4. The apparatus according to claim 3, wherein the movable plate comprises plural teeth on a lateral side, and the collecting device further comprises a motor comprising a gear which meshes with the plural teeth.

5. The apparatus according to claim 4, further comprising:

a first brush roller installed above the collecting device; and a second brush roller installed below the collecting device and supported on the movable plate.

6. The apparatus according to claim 5, wherein the brush rollers rotate in a direction opposite to a direction in which the sheet is conveyed.

7. The apparatus according to claim 6, comprising a reading unit which is arranged downstream in the sheet conveyance direction from the heating device and reads the image on the sheet, wherein the control unit separates and collects, by the size of the sheet, the sheet that is determined as successful in the image erasure based on the image read by the reading unit.

8. The apparatus according to claim 1, comprising a reading unit which is arranged downstream in the sheet conveyance direction from the heating device and reads the image on the sheet, wherein the control unit separates and collects the sheet on which image erasure is successful and the sheet on which image erasure is unsuccessful, based on an output from the reading unit.

9. The apparatus according to claim 1, wherein the control unit causes the collecting device to collect the sheet if it is determined that double-feed is detected based on an output from the detection unit.

10. The apparatus according to claim 1, wherein the control unit causes the collecting device to collect the sheet when it is detected that the sheet is thicker than a first threshold set in advance or when it is detected that the sheet is thinner than a second threshold set in advance.

11. An image erasing method for an image erasing apparatus which erases an image on a sheet on which the image is formed with a color material which is decolorized at a temperature equal to or higher than an erasing temperature, the method comprising:

controlling a sheet conveyance direction of a conveying mechanism so that;

if it is determined, based on an output from a detection unit which detects a state of a fed sheet, that the sheet cannot be fed to a heating device which heats the sheet to a temperature equal to or higher than the erasing temperature and thus decolorizes the image formed on the sheet, the sheet is conveyed to a collecting device which is arranged downstream in the sheet conveyance direction from the detection unit in a sheet conveying path, to collect the sheet, and if it is determined that the sheet can be fed and conveyed to the heating device, the sheet is conveyed to the heating device to erase the image on the sheet.

12. The method according to claim 11, wherein the collecting device is installed downstream in the sheet conveyance direction from the detection unit and upstream in the sheet conveyance direction from the heating device.

13. The method according to claim 12, wherein the collecting device comprises:

a drive roller and a driven roller which nip the sheet between the rollers and thus convey the sheet;

a roller lifting device which lifts and lowers the drive roller; and a movable plate which rotatably supports the driven roller and opens in a perpendicular direction to the sheet conveyance direction.

14. The method according to claim 13, wherein the movable plate comprises plural teeth on a lateral side, and the collecting device further comprises a motor comprising a gear which meshes with the plural teeth.

15. The method according to claim 14, wherein the image erasing apparatus includes:

a first brush roller installed above the collecting device; and a second brush roller installed below the collecting device and supported on the movable plate.

16. The method according to claim 15, wherein the brush rollers rotate in a direction opposite to a direction in which the sheet is conveyed.

17. The method according to claim 16, further comprising:

reading the image on the sheet with a reading unit which is arranged downstream in the sheet conveyance direction from the heating device; and separating and collecting the sheet that is determined as successful in the image erasure by the size of the sheet, based on the image read by the reading unit.

18. The method according to claim 11, further comprising:

reading the image on the sheet with a reading unit which is arranged downstream in the sheet conveyance direction from the heating device; and separating and collecting the sheet on which image erasure is successful and the sheet on which image erasure is unsuccessful, based on the image read by the reading unit.

19. The method according to claim 11, wherein if it is determined that double-feed is detected based on an output from the detection unit, the sheet is collected by the collecting device.

20. The method according to claim 11, wherein when it is detected that the sheet is thicker than a first threshold set in advance or when it is detected that the sheet is thinner than a second threshold set in advance, the sheet is collected by the collecting device.

* * * * *